United States Patent [19]

Kindl

[11] 3,952,877

[45] Apr. 27, 1976

[54] HANGER ROD HAVING SPRING LOADED SUCTION CUP

[75] Inventor: George F. Kindl, Newington, Conn.

[73] Assignee: Loc-Rite, Incorporated, Newington, Conn.

[22] Filed: Apr. 23, 1975

[21] Appl. No.: 570,662

[52] U.S. Cl. ..... 211/105.5; 211/123; 248/356

[51] Int. Cl.[2] ..... A47H 1/08

[58] Field of Search ..... 211/105.1–105.6, 86, 123; 248/356, 509

[56] References Cited

UNITED STATES PATENTS

| | | | |
|---|---|---|---|
| 2,661,836 | 12/1953 | Jewell | 248/509 X |
| 2,903,227 | 9/1959 | Dekalb Key | 211/86 X |
| 2,974,805 | 3/1961 | Brosseau | 211/105.5 |
| 3,327,310 | 6/1967 | Bethune et al. | 248/356 X |

*Primary Examiner*—Roy D. Frazier
*Assistant Examiner*—Terrell P. Lewis

[57] ABSTRACT

A portable hanging rod adapted to extend between two parallel walls includes a rod with means of automatic self adjustment for variations in wall parallelism, separation and squareness. On one end of the rod a cap is positioned and on the opposite end a spring loaded suction cup is attached. The spring load urges the cap and the suction cup into firm engagement with the walls.

2 Claims, 2 Drawing Figures

HANGER ROD HAVING SPRING LOADED SUCTION CUP

BACKGROUND OF THE INVENTION

This invention relates to hanging devices which utilize suction cups.

Prior hanging devices which incorporate suction cups have a tendency to fall off the engaged surfaces due to contact surface finish, or light axial loading forces.

SUMMARY OF THE INVENTION

The invention provides a hanger rod adapted to be placed between two parallel surfaces having a spring biased suction cup at one end thereof. The spring urges the suction cup into compressed contact with one of two opposing surfaces and the end of the rod remote from the suction cup into engagement with the other surface. The suction cup is connected to a dowel which is inserted in the hub portion thereof. The dowel, in turn, is attached to another dowel mounted for axial sliding movement within the rod.

A spring loaded hanger rod assembly of the invention is capable of carrying a substantial load because the spring-urged surface engagement of the compressed suction cup and the free end of the rod engenders a significant friction force which must be overcome for the rod to be displaced. Moreover, a hanger rod according to the invention is adapted to accommodate non-parallel surfaces, minor variations in surface separation and non-perpendicular rod placement.

Accordingly, it is a primary object of the invention to provide a hanger rod having a suction cup attached to one end thereof wherein a spring is provided to bias the suction cup and the other end of the rod into firm engagement with the supporting surfaces.

Another object is to provide a hanger rod which is adapted to be placed between parallel surfaces in perpendicular relationship thereto and which can accommodate variations in surface geometry and variations in the orientation of the rod with respect to the surfaces.

A further object is to provide a hanger rod adapted to be placed between two surfaces separated by a predetermined distance wherein means are provided to compensate for minor variations in the distance between the surfaces.

A still further object is to provide a portable hanger rod which can support a substantial load without being displaced from its supporting surfaces.

These and other objects and advantages of the invention will become more readily apparent from the following detailed description, when taken in conjunction with the accompanying drawings, in which:

DETAILED DESCRIPTION OF PREFERRED EMBODIMENT

Figure 1:
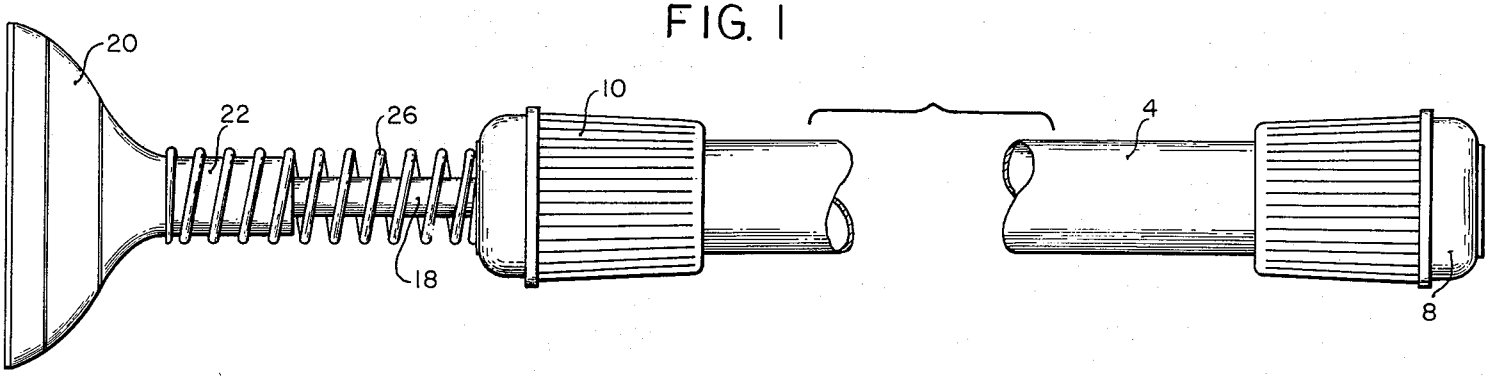
FIG. 1 shows a side elevational view of a hanger rod according to the invention.
Figure 2:
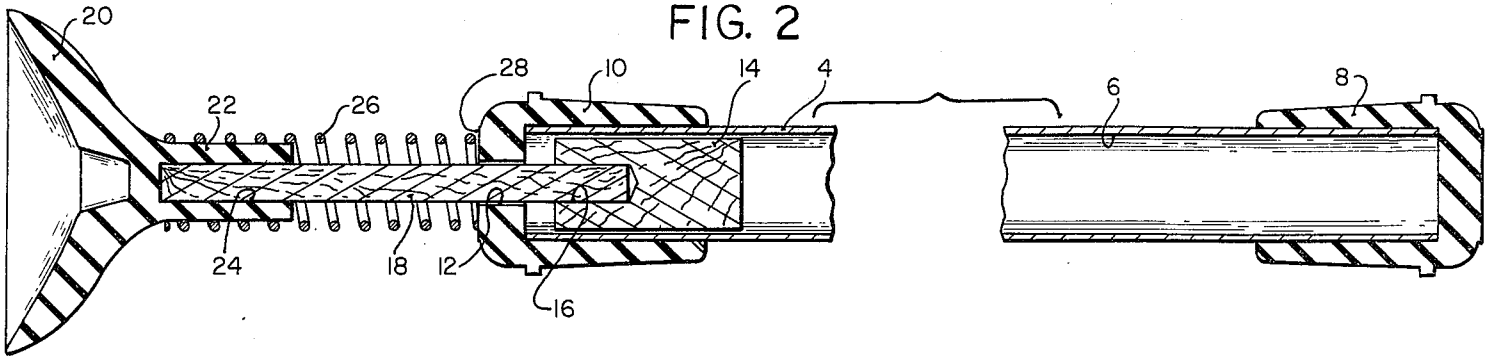
FIG. 2 is a longitudinal sectional view of the hanger rod of FIG. 1.

With reference to FIGS. 1 and 2, wherein a hanger rod of the invention is shown, the hanger rod comprises a rod 4 having a hollow interior portion 6 which extends the length of the rod. Mounted upon the right end of the rod 4 is a rubber end cap 8. The left end of the rod 4 also has a rubber end cap 10 mounted thereupon.

The end cap 10 is provided with a centrally disposed opening 12. Positioned adjacent to the left end of the rod 4 is a cylindrical dowel 14 having an outside diameter slightly less than the inside diameter of the rod 4 such that it is adapted for axial sliding movement therein with a close sliding fit. Press fitted into a cavity 16 in the dowel 14 is an elongated dowel 18 which extends through the opening 12 in the cap 10.

A suction cup 20 has a hub portion 22 which embodies an axially extending cavity 24. The left end of the dowel 18 is received within the cavity 24. A compression spring 26 is interposed between a flat end face 28 of the end cap 10 and the suction cup 20. The spring 26 is coiled about the hub portion 22 in such a manner that the coils exert a radially inward force on the hub to insure tight engagement between the dowel 18 and the wall of cavity 24. As shown in the drawings, the spring 26 is seated upon the face 28 of the end cap 10 and is seated adjacent the beginning of the hub portion 22. The spring 26 serves a dual purpose in that it urges suction cup 20 away from the end of the rod, as defined by the cap 10, and also secures the dowel 18 to the suction cup 20.

By employing a spring load to urge the suction cup 20 and the end cap 8 against two parallel walls between which the hanger rod extends, frictional forces are developed which enables the rod to carry a substantial load while maintaining its position. In addition, the dowel 14 functions to maintain the dowel 18 and the suction cup 20 in axial alignment with the rod 4 and provide the assembly with a degree of rigidity. However, the suction cup 20 may still pivot about the left end of the dowel 18 to thereby compensate for variations in parallelism between the supporting wall surfaces and surface irregularities. It will be further noted that the spring 26 also allows the assembly to accommodate slight variations in the distance between the parallel supporting walls which may be encountered.

In operation, the depicted hanger rod is adapted to be placed between two parallel walls having a specified distance therebetween, such as those which define a doorway or those at the ends of a bathtub. The suction cup 20 is placed against one wall and a longitudinal force applied thereagainst to compress the spring 26 whereby the rod 4 may be pivoted to place the end cap 8 against the opposing wall such that the rod is perpendicular to the walls. The external compressive force is then released to thereby cause the spring 26 to urge the suction cup 20 and the cap 8 against the respective walls, suction cup 20, of course, being compressed. Due to the frictional force developed between the respective walls and the inner surface of the suction cup 20 and the face of the end cap 8, the hanger rod will remain firmly in position, even when a substantial load is hung thereupon. Since the spring 26 and the hub portion 22 of the suction cup are flexible, the hanger rod need not extend between the walls in perfect or near perpendicularity thereto. The axial sliding action of the dowels 14 and 18 within the interior of the rod 4 allows for variations in wall separation to be accommodated.

Obviously many modifications and variations of the illustrated rod are possible without departing from the scope or spirit of the invention as defined in the claims. For example, it should be apparent that only a portion of the rod 4 need be hollow. Furthermore, the left end of the rod 4 could be fashioned to serve as a seat for the spring 26. This would permit the elimination of the end cap 10. Also, it should be obvious that means could be provided to change the length of the rod, such as by having one portion of the rod telescoped within another portion.

I claim:

1. A hanger rod adapted to be inserted between two parallel surfaces comprising:

a rod having a hollow interior portion defining a cylindrical wall;

means mounted upon one end of the rod for engaging one of the surfaces;

a suction cup, having a hub portion with a cavity therein, located adjacent the other end of the rod, the suction cup being adapted for compressive engagement with the other surface;

a first dowel mounted within the hollow portion for axial sliding movement over the wall thereof;

a second dowel having one end thereof received in the cavity in the hub portion of the suction cup and the other end thereof fixedly connected to the first dowel;

a spring in contact with the suction cup interposed between the suction cup and the second mentioned end of the rod to urge the suction cup away from the rod, the spring being coiled about the hub portion of the suction cup so as to exert a radially inward force on the hub portion which secures the second dowel thereto; and means to provide a seat for the spring at the second mentioned end of the rod.

2. A hanger rod, as defined in claim 1, wherein the spring seating means comprises:

a rubber cap having a flat face with a centrally disposed opening therethrough mounted upon the second mentioned end of the rod, the spring being seated upon the flat face and the second dowel extending through the opening thereof; and wherein the surface engaging means comprises:

a rubber cap mounted upon the first mentioned end of the rod.

* * * * *